United States Patent [19]

Brettschneider et al.

[11] Patent Number: 4,499,592

[45] Date of Patent: Feb. 12, 1985

[54] X-RAY TUBE HAVING FLASHOVER PREVENTION MEANS

[75] Inventors: Horst Brettschneider, Tangstedt; Walter Hartl, Hamburg, both of Fed. Rep. of Germany

[73] Assignee: U.S. Philips Corporation, New York, N.Y.

[21] Appl. No.: 369,958

[22] Filed: Apr. 19, 1982

[30] Foreign Application Priority Data

Apr. 23, 1981 [DE] Fed. Rep. of Germany ..... 3116169

[51] Int. Cl.[3] ..... H01J 35/16

[52] U.S. Cl. ..... 378/121; 313/313

[58] Field of Search ..... 313/242, 313, 590, 613, 313/614, 616; 378/121, 127, 129, 130, 131, 135, 139, 143, 144, 137, 138, 125

[56] References Cited

U.S. PATENT DOCUMENTS

| | | | |
|---|---|---|---|
| 3,728,573 | 4/1973 | Roeber | 313/242 X |
| 4,024,424 | 5/1977 | Eggelesmann et al. | 378/131 |
| 4,205,250 | 5/1980 | Ohara | 313/613 X |

*Primary Examiner*—David K. Moore
*Assistant Examiner*—K. Wieder
*Attorney, Agent, or Firm*—Robert J. Kraus

[57] ABSTRACT

In high-voltage vacuum-tubes, specifically X-ray tubes, comprising an electrode (anode) which carries a positive high voltage and which is connected to a conductive part (for example the metal tube envelope) via an insulator, flashover may occur at very high temperatures. In order to preclude such flashover a shielding electrode is arranged at a small distance from the insulator and has such a shape that the electric field strength at the location where the insulator is connected to the conductive part is reduced.

6 Claims, 4 Drawing Figures

X-RAY TUBE HAVING FLASHOVER PREVENTION MEANS

BACKGROUND OF THE INVENTION

The invention relates to a high-voltage vacuum-tube, specifically an X-ray tube, which comprises an electrode disposed in its vacuum space, which electrode, in the operating condition, carries a positive high voltage relative to an electrically conductive part by which it is at least partly enclosed. The electrode or a part connected to the electrode is connected to the conductive part via an insulator which is constructed so that in the operating condition the electrons which impinge over at least a substantial part of its surface area, encounters an electric field which field repels said electrons away from the insulator surface.

Such a high-voltage vacuum-tube is known from DE-OS No. 25 06 841 corresponding to U.S. Pat. No. 4,053,802. The electrode is then generally the anode of the high-voltage vacuum-tube. In the case of rotary-anode X-ray tunbes the electrode may be the shaft carrying the anode disc, which shaft is at the same potential as the anode disc. In general the electrically conductive part is the metal tube envelope of such a tube or a part thereof. Alternatively, in the case of rotary anode X-ray tubes, it may be a metal cylinder, which rotates together with an insulator and the shaft of the rotary-anode disc and which is connected to the housing of the X-ray tube via a bearing, as is known from DE-PS No. 24 55 974 corresponding to U.S. Pat. No. 4,024,424. Usually the insulator is constructed so that its frusto-conical inner jacket widens from the location where it is connected to the electrode in the axial direction.

In the known high-voltage vacuum-tube the shape of the insulator precludes insulator-surface flashover, which could impair the reliability of operation of the tube. However, in tubes which are subject to a substantial thermal load the increased temperature of the insulator reduces the binding energy of gaseous layers adsorbed at the surface, so that electron-stimulated desorption may increase and may rise to flash-over effects (R. A. Anderson, J. P. Brainard: Mechanism of pulsed surface flashover involving electron-stimulated desorption, J. Appl. Phys. 51, 1414, (1980)).

SUMMARY OF THE INVENTION

It is an object of the present invention to construct a high-voltage vacuum-tube of the type mentioned in the opening paragraph in such a way that even at high thermal loads flashover is minimized. According to the invention this object is achieved by positioning, at the location of the connection between the insulator and the conductive part, a shielding electrode carrying the potential of the conductive part. The shielding electrode is arranged at a small distance from the insulator, and is constructed so as to reduce the electric field strength at the location of the connection. The inventors have recognized that the flashover effects during operation at substantial thermal loads originate at the location of the connection between the insulator an the conductive part, which is exposed to the electric field between the conductive part and the electrode, especially when at this location the insulator is brazed to the electrically conductive part. Since the shielding electrode reduces the electric field at this location flash-over is minimized.

Even in the case of careful finishing (electropolishing) the shielding electrode may exhibit minor inhomogeneities, which form emission points during operation. If the electrons emitted by these emission points travel from the insulator surface to the electrode (anode), this may again give rise to discharges. In order to minimize this possibility, in accordance with a further embodiment of the invention, the shielding electrode is arranged in such a way relative to the insulator, that most electrons emitted from the shielding-electrode surface which is remote from the conductive part cannot impinge on the inner surface of the insulator. Specifically the shielding electrode turns away from the generated surface defined by the inner surface of the insulator, so that it does not intersect the extension of the conical inner surface of the insulator.

In a further embodiment of the invention the insulator is constructed so that between the insulator and the conductive part a cavity is formed, which is open towards the shielding electrode. In this way the area where the insulator and the conductive part are connected to each other is largely protected against discharge carriers which travel through the space between the shielding electrode and the insulator towards the electrically conductive part, thereby precluding flashover effects in a particularly effective manner.

BRIEF DESCRIPTION OF THE DRAWING

Embodiments of the invention will now be described in more detail, by way of example, with reference to the drawing. In the drawing

DESCRIPTION OF THE PREFERRED EMBODIMENTS

Figure 1:
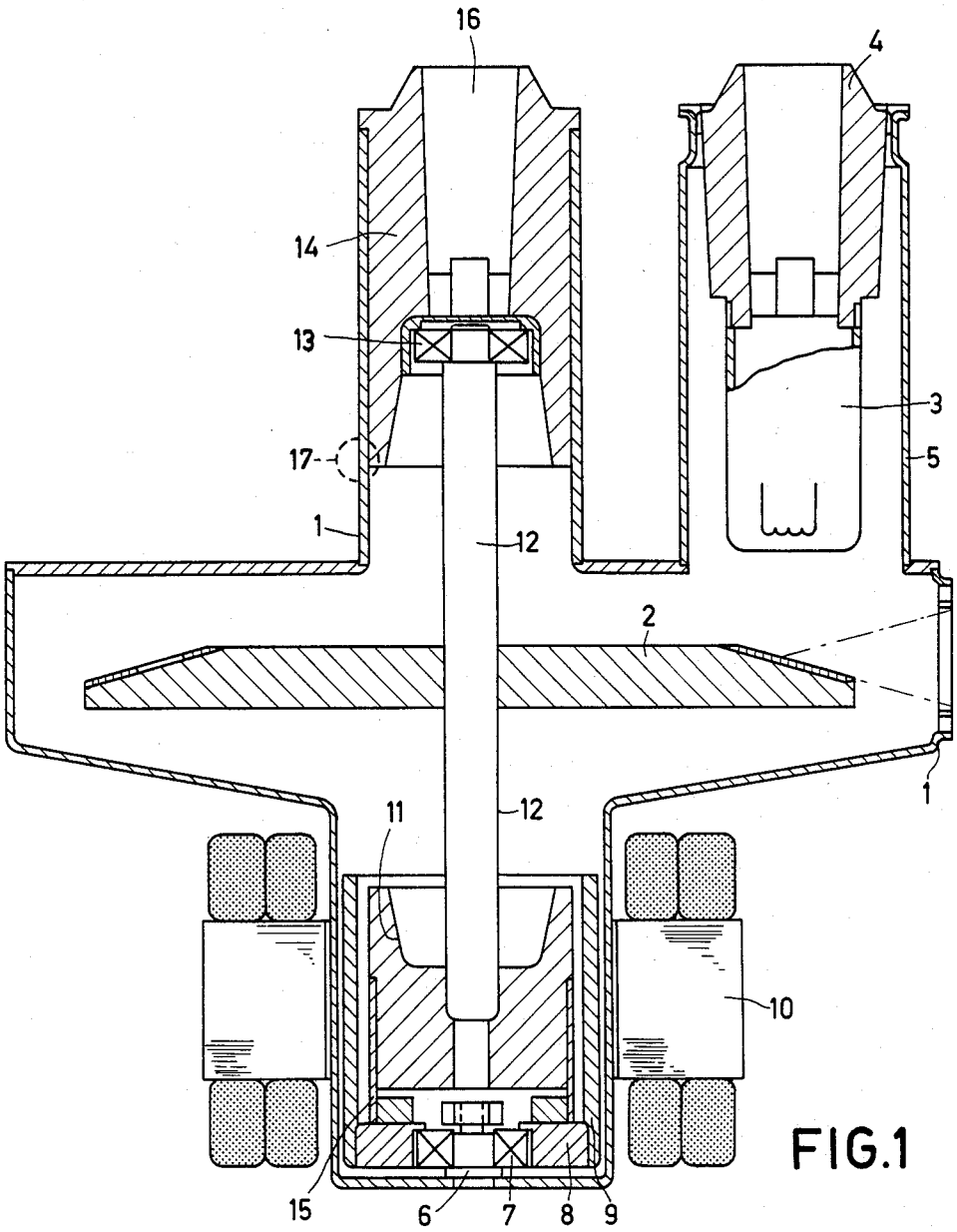
FIG. 1 represents a known X-ray tube.

The problems to be solved by the invention will be set forth again with reference to FIG. 1 which shows a known X-ray tube. FIG. 1 shows an X-ray tube whose envelope 1 is entirely made of metal. The envelope 1 is essentially rotationally symmetrical. The anode disc 2 comprises a flattened focal spot, arranged opposite the cathode 3 which via an insulator 4 is connected to a metal cylinder 5, which in turn is connected to the envelope which has an opening at this location. The anode is journalled at two locations. At the lower end of the metal envelope there is provided a journal 6, which is concentric with the axis of rotation and which carries a bearing 7 which via a ring 8 is connected to the cylindrical rotor 9. The journal 6, the bearing 7 and the ring 8 constitute a conductive connection between the envelope and the rotor 9, so that the rotor is earthed via the metal envelope. The ring 8, and thus the rotor 9, is connected to an insulator 11 via a further ring 15, which insulator is secured to a shaft 12 carrying the anode disc 2.

The high voltage is applied to the anode via a bearing 13, which is accomodated in an insulator 14 which is connected to the tube envelope 1 and which has a conical recess 16 for receiving a high-voltage connector. The ball-bearing 13 serves for journalling the shaft 12. Thus, the high voltage is applied to the anode disc 2 via the bearing 13 and the shaft 12.

When the X-ray tube is subjected to a normal thermal load, flashover is precluded by the shape of the insulator 11. However, at very high thermal loads flash-over may occur in such an X-ray tube, in particular if the insulator 14 and the envelope 1 are connected to each other by brazing. The critical area is the area 17 where the envelope 1, the insulator 14 and the tube-vacuum adjoin each other. This area, which as will be apparent from the drawing, is not restricted to a point but concentrically surrounds the shaft 12, is exposed to the electric field between the envelope 1 and the shaft 12. In the case of excessive thermal loads it may assume temperatures which are substantially higher than 100° C.

Figure 2:
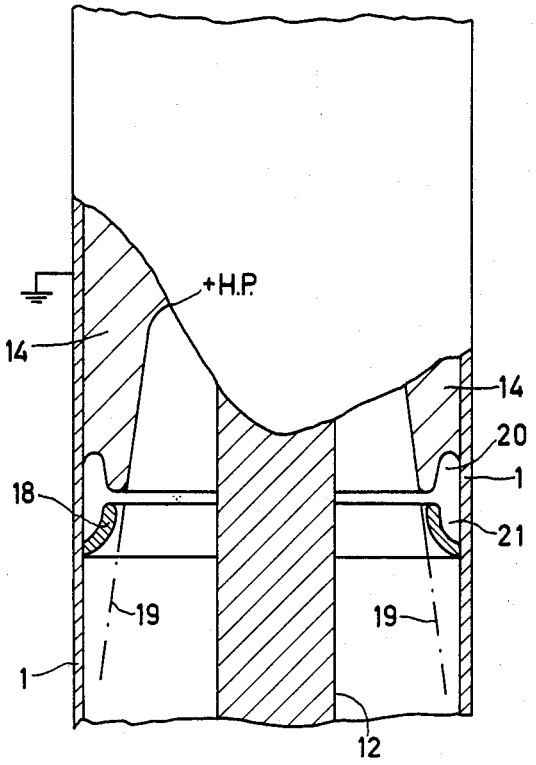
FIG. 2 shows a part of such an X-ray tube constructed in accordance with the invention.

FIG. 2 shows a part of the metal envelope with the insulator 14 and the shielding electrode in accordance with the invention in a partly cut-away view and on an enlarged scaled compared with FIG. 1. The annular shielding electrode 18 is located in the immediate vicinity of the insulator end at the critical area 17 where the envelope 1, the insulator and the vacuum adjoin each other. The shielding electrode is suitably made of pure iron or another metal, for example Cr-Ni steel, and is welded to the inner side of the metal envelope 1, concentrically with the shaft 12.

Both the shielding electrode and the insulator are constructed so that they form a groove-like cavity with the envelope 1, which cavity opens towards the insulator or the shielding electrode. This construction reduces the field strength in the critical area and charge carriers which traverse the gap between the shielding electrode 18 and the insulator 14 cannot directly reach the critical area.

The clearance between the facing ends of the insulator 14 and the shielding electrode 18 is approximately 1 mm. It should not exceed 3 mm. If it is substantially smaller than 0.5 mm, very high field strengths will occur in this gap, which may give rise to field emission on the upper surface of the shielding electrode 18. Moreover, the shielding electrode then cannot be conditioned correctly. If said gap is substantially greater than 3 mm, the electric field in the critical area between the metal envelope 1, the insulator 14 and the vacuum is hardly reduced by the shielding electrode 18.

Suitably, the shielding electrode is finished in such a way, for example by electropolishing, that hardly any emission points are located on its surface. In order to prevent electrons still emitted from its surface from impinging on the insulator surface which faces the shaft 12 and, via this surface, from travelling to the shaft 12 or the ball-bearing 13 connected thereto (FIG. 1), as a result of which flashover may occur, the electrode 18 should be arranged so that electrons emitted by it travel directly to the shaft 12 and cannot reach the insulator. For this purpose the shielding electrode is suitably arranged so as to recede, i.e. its inner diameter is proportioned so that the frustoconical inner surface of the insulator 14, which widens towards the shielding electrode, or its extension represented by the lines 19, do not intersect the shielding electrode 18.

Figure 3:
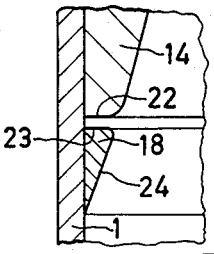
FIGS. 3 and 4 show different embodiments of the invention.

A different embodiment of the invention is represented in FIG. 3, which shows a part of an X-ray tube in accordance with the invention. Facing surfaces of the insulator 14 and the shielding electrode 18 are substantially flat and extend substantially perpendicularly to the wall of the metal envelope 1. This reduces the field strength in the critical zone between the envelope, the insulator 14 and the vacuum, but charge carriers which pass through the gap can directly reach this zone. Therefore, this embodiment is not as effective as the one shown in FIG. 2.

Figure 4:
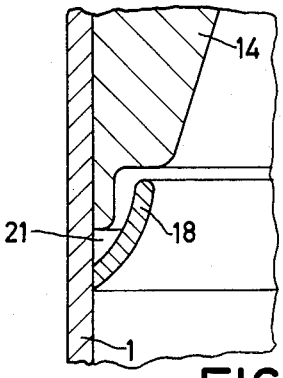

FIG. 4 finally shows a further embodiment. The shielding electrode 18 has the same shape as that in FIG. 2, i.e. together with the wall of the envelope 1 it bounds a groove-like circumferential cavity which is open toward the insulator 14, into which cavity a comparatively thin end portion of the insulator 14 projects.

Although in the foregoing the invention has been described for a stationary insulator, it may in principle also be used in conjunction with a rotary insulator. If, for example in FIG. 1 the earthed metal ring 15 is so long that an area or zone is obtained in which the vacuum space, the metal ring 15 and the insulator 11 adjoin each other and which is exposed to the electric field between the metal ring 15 and the shaft 12, the invention may also be utilized in this case.

The invention is not limited to rotary-anode X-ray tubes. It may also be utilized in other X-ray tubes and other high-voltage vacuum tubes (for example neutron tubes).

What is claimed is:

1. An X-ray tube comprising:

(a) an electrically-conductive housing;

(b) an insulator having a cavity at one end, said end including an outer surface, an inner surface defining the cavity, and an end surface extending between the inner and outer surfaces, said end being disposed within and affixed to the housing;

(c) a high-voltage electrode at least partly enclosed within the housing, said high voltage electrode extending into the cavity and being secured to the insulator;

characterized in that said X-ray tube includes a shielding electrode electrically-connected to the housing, said shielding electrode being disposed within the housing such that it is closely-spaced from the end surface of the insulator and being shaped such that it inhibits impingement on the inner surface of the insulator of any electrons emitted by the shielding electrode.

2. An X-ray tube as in claim 1 where the shielding electrode is shaped such that it does not extend toward the high-voltage electrode further than the end surface of the insulator.

3. An X-ray tube as in claim 1 or 2 where the shielding electrode extends arcuately from the inner surface of the housing and forms a hollow which opens toward the end surface of the insulator.

4. An X-ray tube as in claim 3 where the end surface of the insulator includes a projecting portion extending into the hollow formed by the shielding electrode.

5. An X-ray tube as in claim 1 or 2 where the end surface of the insulator includes an indentation which opens toward said shielding electrode.

6. An X-ray tube as in claim 1 or 2 where the end surface of the insulator is flat and extends perpendicularly from the housing.

* * * * *